US008302660B2

(12) United States Patent
Erhard et al.

(10) Patent No.: US 8,302,660 B2
(45) **Date of Patent: *Nov. 6, 2012**

(54) FEED BLOCK UNIT, FEED SYSTEM AND CONTROL DEVICE FOR A PRESSURE DIE-CASTING MACHINE

(75) Inventors: Norbert Erhard, Lorch (DE); Dietmar Gerwig, Unterensingen (DE); Herbert Trebes, Schorndorf (DE)

(73) Assignee: Oskar Frech GmbH + Co. KG, Schorndorf-Weiler (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/328,210

(22) Filed: Dec. 16, 2011

(65) Prior Publication Data

US 2012/0145352 A1 Jun. 14, 2012

(30) Foreign Application Priority Data

May 24, 2007 (EP) ..... 07010321

(51) Int. Cl.
*B22D 17/32* (2006.01)

(52) U.S. Cl. ..... 164/154.6

(58) Field of Classification Search ..... 164/312, 164/316, 338.1, 154.6, 155.6; 425/548
See application file for complete search history.

(56) References Cited

U.S. PATENT DOCUMENTS

| | | | |
|---|---|---|---|
| 5,268,184 A | 12/1993 | Gellert | |
| 5,542,835 A | 8/1996 | Kennedy et al. | |
| 6,095,790 A | 8/2000 | Gellert et al. | |
| 6,230,384 B1 | 5/2001 | Gellert et al. | |
| 6,405,785 B1 | 6/2002 | Gellert et al. | |
| 6,701,997 B2 | 3/2004 | Gellert et al. | |
| 6,830,094 B2 | 12/2004 | Fink | |
| 7,040,378 B2 | 5/2006 | Gellert et al. | |
| 7,198,740 B2 | 4/2007 | Gellert et al. | |
| 7,810,549 B2 | 10/2010 | Li et al. | |
| 8,104,529 B2 * | 1/2012 | Erhard et al. | 164/154.6 |

FOREIGN PATENT DOCUMENTS

| | | |
|---|---|---|
| DE | 199 10 853 A1 | 9/1999 |
| DE | 103 59 692 A1 | 7/2004 |
| EP | 1 201 335 A1 | 5/2002 |

(Continued)

OTHER PUBLICATIONS

European Search Report dated Jan. 22, 2008 w/English translation of pertinent portion (twelve (12) pages).
European Search Report dated Sep. 25, 2007 w/English translation of pertinent portion five (5) pages).

(Continued)

*Primary Examiner* — Kevin P Kerns
(74) *Attorney, Agent, or Firm* — Crowell & Moring LLP

(57) ABSTRACT

A feed block unit for a hot-runner feed system of a pressure die-casting machine includes a block body in which is incorporated at least one melt-conveying channel running out of the block body by way of a sprue orifice close to the gate, and a heating system, integrated into the block body, for the at least one melt-conveying channel. The feed block unit is designed as a structural unit which is insertable independently into a respective casting mold, and/or the heating system integrated therein includes at least a first heating device for supply channel heating and a second heating device, which can be controlled independently of the first heating device, for sprue channel heating. With this modular hot-runner feed system, individual temperature profiles can be predetermined and set for the respective feed block unit.

4 Claims, 3 Drawing Sheets

FOREIGN PATENT DOCUMENTS

| | | | | |
|---|---|---|---|---|
| EP | 1 264 001 | B1 | | 11/2002 |
| JP | 63-137561 | A | * | 6/1988 |
| JP | 2000-6221 | A | * | 1/2000 |
| JP | 2004-174991 | A | * | 6/2004 |
| WO | WO 03/018236 | A1 | | 3/2003 |

OTHER PUBLICATIONS

European Search report of 10194415.5-2122 dated Feb. 7, 2011.

First Office Action in Chinese Patent Application No. 200810109108.9 dated Dec. 7, 2010.

* cited by examiner

FEED BLOCK UNIT, FEED SYSTEM AND CONTROL DEVICE FOR A PRESSURE DIE-CASTING MACHINE

CROSS-REFERENCE TO RELATED APPLICATION

This application is a continuation application of U.S. Pat. No. 8,104,529, filed May 23, 2008, which claims the priority of European Application No. 07010321.3, filed May 24, 2007, the disclosures of which are expressly incorporated by reference herein.

BACKGROUND AND SUMMARY OF THE INVENTION

The invention relates to a feed block unit for a hot-runner feed system of a pressure die-casting machine, wherein the feed block unit includes a block body in which there is incorporated at least one melt-conveying channel running out of the block body by way of a sprue orifice close to the gate, and a heating system, integrated into the block body, for the at least one melt-conveying channel. Furthermore, the invention relates to a hot-runner feed system and to a control device for such a pressure die-casting machine.

EP patent 1 201 335 B1 discloses a hot-runner feed system of the above-mentioned type, which is designed, for example, as a comb-type or fan-type feed system. In such a system, a feed part, which is a non-detachable component of a fixed mould half, contains a plurality of nozzles or feed elements in a distributed arrangement, each comprising a central supply channel and a nozzle tip with one or more sprue channels which adjoin the supply channel and have a smaller channel cross section in relation thereto. The sprue channels each terminate in a sprue orifice close to the gate. This means that the sprue orifice in question directly forms the so-called gate or is situated immediately in front of this gate region. The gate or gate region refers to that point at which the cast shape breaks away from the residual sprue of the melt, i.e., the gate forms the predetermined breaking point for the cast shape of solidified melt in the adjoining sprue region. This means that the sprue orifice in this feed system is situated directly at the edge of the mould cavity or immediately in front of it. The melt is fed into the nozzle supply channels from a feed mouthpiece, which is formed at the inlet side of the feed part, via distributing runner channels in the feed part. The runner channels can be heated, and in addition each nozzle is assigned its own heating element in the form of an electric heating element, which surrounds the cylindrical nozzle body.

The technical problem underlying the invention is that of providing a feed block unit of the above-mentioned type, together with a hot-runner feed system and a control device for a pressure die-casting machine, whereby the flexibility of the feed system of pressure die-casting machines, the heating of the melt in the feed system, and/or the control of the pressure die-casting machine can be improved in relation to the prior art.

The feed block unit according to the invention is designed as a structural unit which can be inserted independently into a respective casting mould and which includes a block body, in which at least one melt-conveying channel is incorporated, and a heating system integrated into the block body. In other words, the feed block unit is not a fixed, non-detachable feed block part of a casting mould or mould half, but instead may be used in a modular and flexible fashion in various casting moulds which for this purpose are provided with corresponding mounting openings. It is also possible in this respect for a plurality of such feed block units to be used in any desired, arrangement configuration depending on the size and shape of the casting mould. The at least one melt-conveying channel runs out of the block body of the feed block unit by way of a sprue orifice close to the gate, which means that the feed block unit forms, or is mounted immediately upstream of, the gate region for the respective mould by way of this sprue orifice close to the gate. This, in turn, means that by using this feed block unit the melt can be actively heated over its feedpath right up until it reaches the mould cavity.

In the feed block unit according to the invention, the at least one melt-conveying channel includes at least one supply channel and at least one sprue channel leading therefrom to the associated sprue orifice close to the gate, and the heating system integrated into the block body of the feed block unit includes at least a first controllable heating device for supply channel heating and a second heating device, which can be controlled independently of the first heating device, for sprue channel heating. The thus possible independent active heating of the supply channel, on the one hand, and the sprue channel, on the other hand, allows comparatively variable temperature profiles to be set for the path followed by the melt in the feed block unit. As a result, it is possible for the temperature profile for the path of the melt in the feed block unit, from the supply channel inlet to the sprue orifice close to the gate, to be adapted variably to the respective application and in this way to be optimized.

In one embodiment of this aspect of the invention, the first and/or the second heating device includes a plurality of electric heating circuits. Consequently, the supply channel heating and/or the sprue channel heating can be further optimized in corresponding applications. If required, it is possible for the plurality of electric heating circuits for supply channel heating and/or sprue channel heating to be controlled separately, thereby further improving the heating of the melt on its path through the feed block unit.

In one development of the feed block unit according to the invention, the at least one supply channel extends in an axial direction, and the at least one sprue channel leads transversely away from the supply channel. It is therefore possible in this feed block unit for melt to be fed in axially and then to be introduced into the mould cavity in the transverse direction.

The hot-runner feed system is equipped with one or more feed block units according to the invention and with a manifold block structure on which the one or more feed block units are mounted on a feed side. The manifold block structure is provided with one or more runner channels via which melt can be fed into the melt-conveying channel or channels of the one or more feed block units. In this way, the manifold block structure, together with the feed block unit or units mounted thereon, forms a modular structural unit which can be used variably and which can be variously configured depending on the particular application and inserted into a mould or mould half. In order, for example, to achieve a comb-type hot-runner feed system, a plurality of feed block units can be arranged in a linear, i.e. one-dimensional, configuration or in a two-dimensionally distributed configuration on the manifold block structure and inserted thus into a mould or mould half at distributed points on a feed side.

In one development of the invention, the manifold block structure includes one or more manifold block elements, wherein the respective manifold block element can be actively heated. This ensures a continuously heated distribution of melt, which is fed into the manifold block structure via, for example, an upstream metering unit including a casting plunger and nozzle, to the individual feed block units coupled to the manifold block structure.

The hot-runner feed system includes at least one feed block unit and at least one heating control circuit for the controlled heating thereof, wherein the heating control circuit includes at least two heating elements for the respective feed block unit, which can be controlled individually to set a predeterminable temperature profile. In operation this allows a comparatively variable and precise setting of the temperature for the melt flowing through the feed block unit before the melt passes from there directly into the mould cavity. It will be understood that, if required, further individually controlled heating elements can be provided along the melt flow path situated upstream of the feed block unit.

The control device is intended for controlling a pressure die-casting machine which serves for the production of metal die-cast parts and which includes a hot-runner feed system together with feed system temperature sensors, wherein, in particular, the hot-runner feed system can be a hot-runner feed system according to the invention. The control device is configured to control a respective mould-filling operation dependent on temperature information supplied to it by the feed system temperature sensors. As a result, the mould-filling operation, i.e. the filling of the mould cavity with the melt, can be made dependent on the detected temperature of the melt in the feed system part.

In one development of the invention, this is used to authorize or to start the respective mould-filling operation only when one or more temperatures in the hot-runner feed system detected by the feed system temperature sensors lie within a respectively predetermined setpoint temperature range or setpoint temperature window. It is thus ensured that the mould is cast only when predetermined desired temperature conditions exist in the feed system, for example in one or more feed block units according to the invention used in the hot-runner feed system.

Other objects, advantages and novel features of the present invention will become apparent from the following detailed description when considered in conjunction with the accompanying drawings.

DETAILED DESCRIPTION OF THE DRAWINGS

Figure 1:
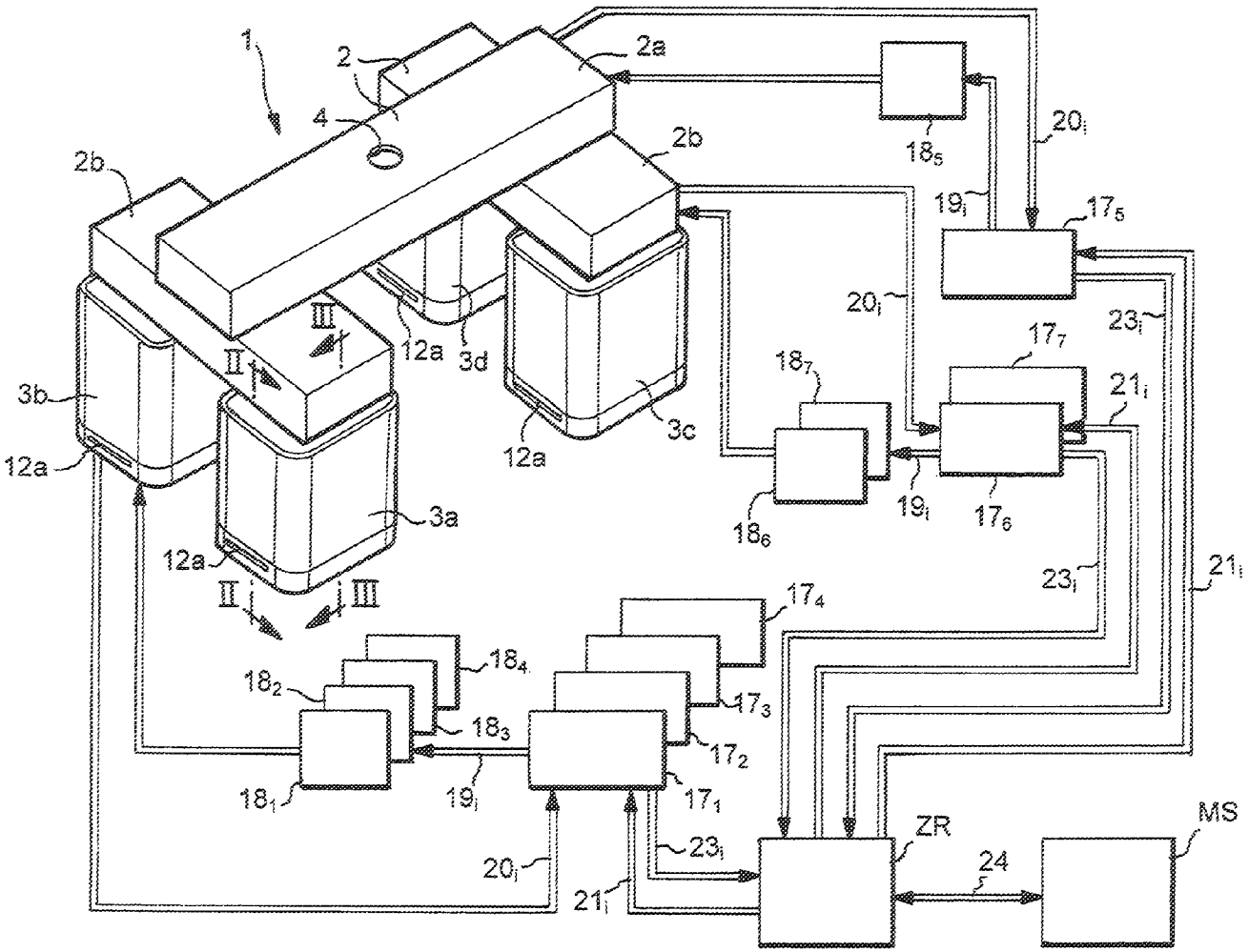
FIG. 1 is a schematic block diagram of a hot-runner feed system, represented in perspective, for a pressure die-casting machine in a quadrangular configuration with an associated open-loop/closed-loop control part.

The feed system part and control part of a pressure die-casting machine which are shown in FIG. 1 with the components of interest here includes a hot-runner feed system 1 having a modular structure. This system includes a manifold block structure 2 and feed block units mounted thereon on a feed side, there being four feed block units 3*a*, 3*b*, 3*c*, 3*d* in the example shown. The pressure die-casting machine can, for example, be a hot-chamber pressure die-casting machine for zinc or magnesium die-casting, alternatively a hot-chamber pressure die-casting machine for other materials which can be cast therewith, or can be a pressure die-casting machine for metal die-casting of the cold-chamber type.

The manifold block structure 2 in the example shown includes a longitudinal manifold block 2*a* and two transverse manifold blocks 2*b* arranged at opposite end regions of the longitudinal manifold block 2*a*. On its upper side as viewed in FIG. 1, the longitudinal manifold block 2*a* is provided with a central inlet opening 4 constituting the feed mouthpiece of the hot-runner feed system 1, to which mouthpiece an end-mounted nozzle of a casting plunger unit of an upstream melt-metering unit of the pressure die-casting machine can be attached in a conventional manner (not shown in further detail here). A longitudinally central runner channel 5, as can be seen in the sectional representation of FIG. 3, runs from the feed mouthpiece 4 to the end regions of the longitudinal manifold block 2*a*, where the runner channel 5 merges into a respective longitudinally central runner channel 6 in the respective, fluid-tightly coupled transverse manifold block 2*b*, which in turn merges at the end regions into a supply channel 7 in the respective, fluid-tightly coupled feed block unit 3*a* to 3*d*.

Each feed block unit 3*a* to 3*d* is constructed in the same way from a block body 8 having an integrated heating system. The structure of the respective feed block unit 3*a* to 3*d* can be seen in more detail from the sectional views shown in FIGS. 2 and 3. Specifically, in the example shown, it includes a T-shaped basic body 9 with an elongate central pillar 9*a*, in which the supply channel 7 is incorporated as a central axial bore, and a foot part 9*b* projecting transversely away therefrom. In the foot part 9*b* are formed sprue channels 11*a*, 11*b*, which lead off transversely from the outlet of the supply channel 7 to two opposite sides and which run out from the corresponding lower side region of the feed block unit 3*a* to 3*d* by way of a respective slot-shaped sprue orifice 12*a*, 12*b* close to the gate. In the bottom region below the sprue channels 11*a*, 11*b*, a thermal insulating layer 10 is provided in the foot part 9*b*.

The supply channel 7, together with the two sprue channels 11*a*, 11*b* which lead off transversely therefrom on the end side and which each preferably have a smaller passage cross section than the supply channel 7, form a melt-conveying channel through which, in operation, the melt fed in via the manifold block structure 2 is conveyed in the respective feed block unit 3*a* to 3*d* directly to the gate region of a mould and thus directly into, or to a point immediately before, a mould cavity which is to be filled with the melt. The heating system integrated into the block body 8 is used in a targeted manner to actively heat this melt-conveying channel system of the feed block unit 3*a* to 3*d*.

For this purpose, the integrated heating system includes a first heating device, which serves primarily for supply channel heating, and a second heating device, which serves primarily for sprue channel heating. The second heating device is controllable separately from the first heating device under open-loop or closed-loop control. In the example shown, the first heating device includes two separately controllable heating circuits 13*a*, 13*b* which are arranged on the peripheral surface of the central pillar 9*a*, and the second heating device includes two separately controllable electric heating circuits 14*a*, 14*b*, which can likewise be controlled separately from one another and separately from the heating circuits 13*a*, 13*b* of the first heating device and are arranged on the foot part 9*b* of the basic body 9. The electric heating circuits 13*a* to 14*b*, which, for example, can be embodied by use of suitably configured heating wire elements, are shielded outwardly and upwardly by a thermal insulating ring 15, which in turn is surrounded by an outer shell 16 of the feed block unit 3*a* to 3*d*. The outer shell is arranged outwardly flush with the foot part 9*b*.

Figure 2:
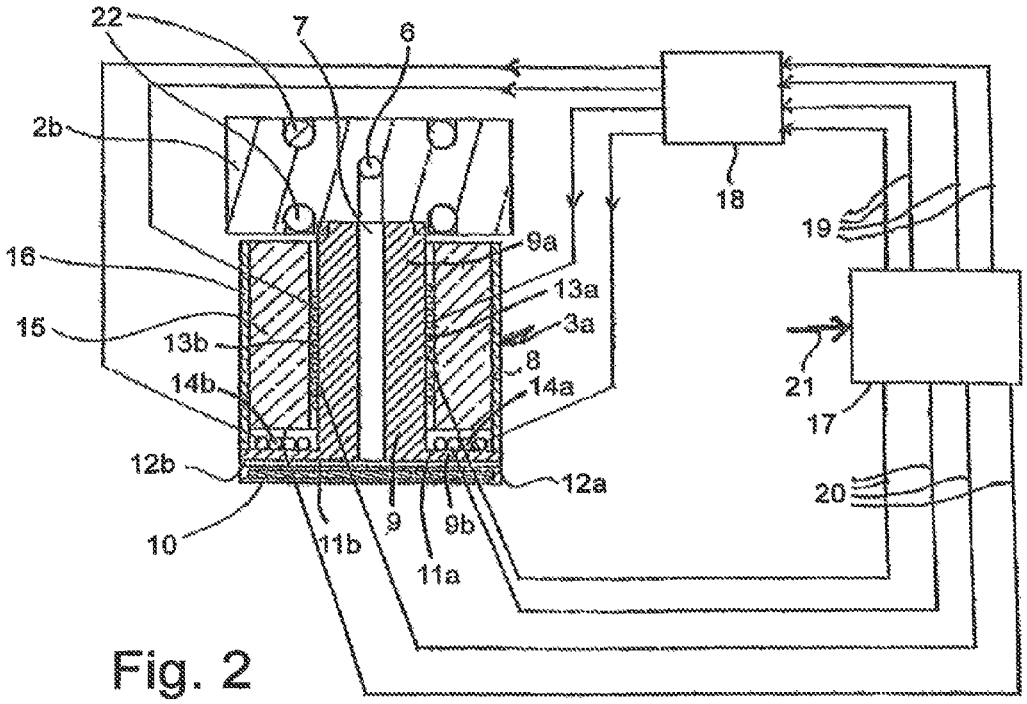
FIG. 2 is a longitudinal sectional view of the feed system of FIG. 1 taken along line II-II in FIG. 1 with an associated heating control circuit.

As represented in FIG. 2, the integrated heating system of each feed block unit 3*a* to 3*d* is respectively assigned a heating control circuit with a control unit 17 which, via an electrical amplifier 18, emits suitable control signals 19, i.e. heating current signals, separately for each of the separately controllable heating circuits or heating elements 13*a* to 14*b*. Conventional temperature sensors (not shown in further detail here), which are arranged at a suitable point in the vicinity of the respective heating circuit 13*a* to 14*b*, are used to supply corresponding actual temperature information 20 regarding each heating circuit 13*a* to 14*b* to the control unit 17, which generates the control signals 19 dependent on this information while taking account of setpoint value information 21 which can be entered via a setpoint value input.

By virtue of the arrangement of the second heating device for sprue channel heating in addition to the first heating device for supply channel heating, it is possible with this heating control circuit, by suitably presetting the corresponding temperature setpoint value information, to select in a highly variable manner and to maintain very exactly a desired temperature profile for the heated melt-conveying channel in the feed block unit 3*a* to 3*d* that is made up of the supply channel 7 and the sprue channels 11*a*, 11*b*. In particular, the two separately controllable heating devices make it possible to set and maintain a desired temperature in the region of the sprue channels 11*a*, 11*b* independently of the desired temperature for the supply channel 7. If, as in the example shown, the respective heating device is composed of a plurality of independently controllable heating circuits or heating elements, the temperature profile in the supply channel region and/or in the sprue channel region can, furthermore, be comparatively finely set and controlled. If required, it is also possible here for a temperature profile to be predetermined and set that is variable in a positionally-dependent manner along the melt path or feed path of the melt in the supply channel 7 and/or the sprue channels 11*a*, 11*b*.

It will be understood that in the present hot-runner feed system the melt can also be actively heated beforehand in the manifold block structure 2 prior to reaching the feed block units 3*a* to 3*d*. For this purpose, use is made of corresponding further heating devices with heating elements integrated into the longitudinal manifold block 2*a*, for example heating wires 23 shown in FIG. 3, and heating elements integrated into the transverse manifold blocks 2*b*, for example heating wires 22 shown in FIG. 2.

As can be seen from FIG. 1, the heating control circuit shown in FIG. 2 for one of the feed block units 3*a* is part of an overall heating control circuit for all, the actively heated components of the hot-runner feed system 1, including a master central control unit ZR, individual control units $\mathbf{17}_1$ to $\mathbf{17}_4$ and associated control signal amplifiers or power parts $\mathbf{18}_1$ to $\mathbf{18}_4$ for each of the feed block units 3*a* to 3*d*, an individual control unit $\mathbf{17}_5$ with an associated power part 185 for the controlled heating of the longitudinal manifold block 2*a*, and two individual control units $\mathbf{17}_6$, $\mathbf{17}_7$ with a respectively associated power part $\mathbf{18}_6$, $\mathbf{18}_7$ for the separate heating of each of the two transverse manifold blocks 2*b*. Each of the individual control units $\mathbf{17}_1$ to $\mathbf{17}_7$ corresponds in its mode of operation to the control unit 17 shown in FIG. 2 and receives actual temperature value information $\mathbf{20}_i$ from a temperature sensor which is assigned to each control unit and which is suitably arranged in the respective feed block unit 3*a* to 3*d* and in the transverse manifold blocks 2*b* and the longitudinal manifold block 2*a*. Furthermore, each of these control units $\mathbf{17}_1$ to $\mathbf{17}_7$ receives associated setpoint value information $\mathbf{21}_i$ from the central control unit ZR and, dependent on this information and the received, sensed temperature information $\mathbf{20}_i$, emits a control signal $\mathbf{19}_i$ which prompts the associated power part $\mathbf{18}_1$ to $\mathbf{8}_7$ to emit corresponding heating power to the heating elements in the feed block units 3*a* to 3*d*, the transverse manifold blocks 2*b*, and the longitudinal manifold block 2*a* (i=1, . . . , 7).

Moreover, each individual control unit $\mathbf{17}_1$ to $\mathbf{17}_7$ emits an associated status signal $\mathbf{23}_i$ to the central control unit ZR, this status signal containing information on the temperature in the associated feed system region which is heated by that heating element or heating circuit which is controlled by this control unit. In particular, this status signal $\mathbf{23}_i$ contains information on whether the temperature set by the respective individual control circuit lies within a setpoint temperature window or setpoint temperature range predetermined by the setpoint value information $\mathbf{21}_i$, or not.

Thus, it is possible in a highly flexible and variable manner for individual setpoint temperatures or setpoint temperature ranges to be predetermined as temperature profiles to be maintained by the central control unit ZR, separately for each of the feed block units 3*a* to 3*d*, the two transverse manifold blocks 2*b*, and the longitudinal manifold block 2*a*. These temperature profiles then are set by the individually assigned individual control circuits. Depending on the particular system layout and application, the central control unit ZR can perform further open-loop/closed-loop tasks in addition to the aforementioned heating control for the hot-runner feed system. In the example shown, the central control unit ZR is in bidirectional communication with a central machine control unit MS of the pressure die-casting machine via link 24.

In the present case, this is used inter alia to inform the central machine control unit MS whether the heating temperature profiles or setpoint temperature ranges predetermined individually for the various heatable components of the hot-runner feed system 1 have been reached or are being maintained. The central machine control unit MS uses this information to authorize or start a respective mould-filling operation, and hence feed melt into the hot-runner feed system 1, only when it has been informed by the central control unit ZR that all of the predetermined temperature profiles or setpoint temperatures for the individually heatable components of the hot-runner feed system 1, i.e. for the feed block units 3*a* to 3*d*, the transverse manifold blocks 2*b*, and the longitudinal manifold block 2*a*, have been reached or maintained. This avoids carrying out a disadvantageous mould-filling operation in which the temperature in one or more components of the hot-runner feed system 1, for example the temperature in the longitudinal manifold block 2*a* or one of the two transverse manifold blocks 2*b* or the temperature for the supply channel 7 and/or the temperature for at least one of the two sprue channels 11*a*, 11*b* in one of the feed block units 3*a* to 3*d*, does not lie within the desired, predetermined setpoint temperature window.

A further noteworthy advantage of the invention is the modular construction of the hot-runner feed system 1, which can be embodied in virtually any desired configuration from one or more feed block units, that which are designed as structural units that can be inserted independently into a respective casting mould, and from an upstream manifold block structure. Depending on the size and type of the casting mould, it is possible for a suitable number of feed block units, for example having the structure shown in FIGS. 2 and 3, to be inserted into corresponding recesses in a fixed mould path while being distributed over this mould half.

FIG. 1 shows, by way of example, a configuration with four feed block units having a rectangular distribution. The manifold block structure designed in a complementary manner thereto and having a longitudinal manifold block and two transverse manifold blocks ensures that the melt is distributed to the feed block units and at the same time serves as a common carrier or mounting frame on which the feed block units are mounted. Alternatively, any other number of such independent feed block units in any other geometric arrangement can be used, with a suitable associated, manifold block structure, which in turn, depending on the particular application, can be composed of an individual manifold block or of a plurality of manifold blocks mounted on one another.

Figure 4:
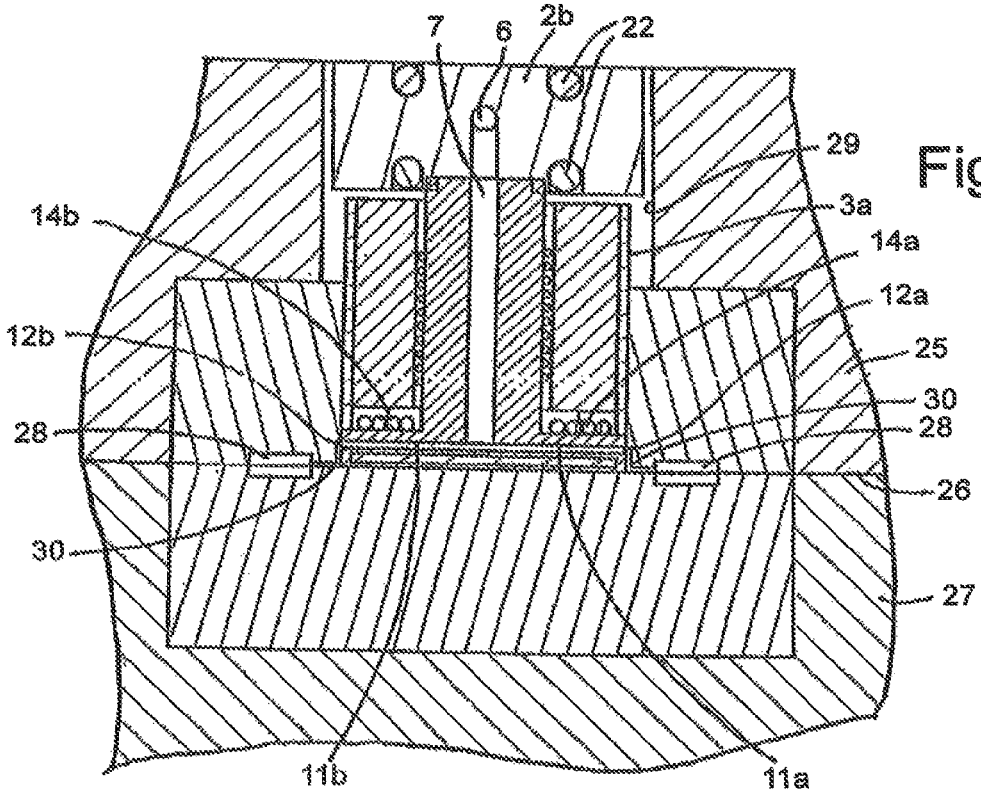
FIG. 4 is a longitudinal sectional view of the feed system of FIG. 1 corresponding to FIG. 2 in an installed position.

FIG. 4 shows the feed system 1 in an installed position in a mould with a fixed mould half 25 and a movable mould half 27 which, when the mould is closed, as shown, bear against one another along a parting plane 26 so as to form a mould cavity 28. The section plane shown in FIG. 4 corresponds to that shown in FIG. 2, i.e. the feed block unit 3*a* with its associated transverse manifold 2*b* can be seen in FIG. 4.

As can be seen in FIG. 4 for this feed block unit 3*a* with the associated transverse manifold block 2*b*, the feed system 1 with its four feed block units and its manifold block structure are inserted into corresponding recesses 29 in the fixed mould half 25. The sprue orifices 12*a*, 12*b* here are situated opposite a gate channel 30, which leads with a short length directly into the mould cavity 28, of which only a small detail can be seen in the section plane shown in FIG. 4.

During the moulding operation, the fed-in melt passes from the runner channel 6 of the transverse manifold block 2*b* into the supply channel 7 of the respective feed block unit, is then distributed into the sprue channels 11*a*, 11*b*, and is forced via the sprue orifices 12*a*, 12*h* and the gate channels 30 into the mould cavity 28. In the process, the melt is actively heated over its feed path until it is discharged from the sprue orifices 12*a*, 12*b*.

In a characteristic manner, the heating in the respective feed block unit, as explained above, can be performed in a highly flexible and sensitive manner by the two heating devices which can be controlled separately under open-loop or closed-loop control, each heating device having one or more heating circuits 13*a*, 13*b* and 14*a*, 14*b* for heating the supply channel 7 and the sprue channels 11*a*, 11*b* respectively. In particular, a desired temperature profile can be predetermined and maintained here for the feed path of the melt in the respective feed block unit. Hence, the melt can be actively heated under open-loop or closed-loop control in a predeterminable manner directly up until it enters the mould cavity 28 via the gates 30.

According to the invention, a hot-runner feed system can be made available with a whole set of distinct configurations of feed block units with a respective associated manifold block structure for use in different casting moulds. Since, moreover, the respective feed block unit is designed as a structural unit which can be inserted independently into a respective casting mould and is therefore not a non-detachable component of a fixed mould half or of a feed block mounted non-detachably thereon, the respective feed block unit or a whole hot-runner feed system with one or more feed block units and associated manifold block structure can be used, if required, for different casting moulds, i.e. the feed block unit or the hot-runner feed system, after it has been used initially in a first casting mould, is removed therefrom and can then or later be inserted into another casting mould.

Figure 3:
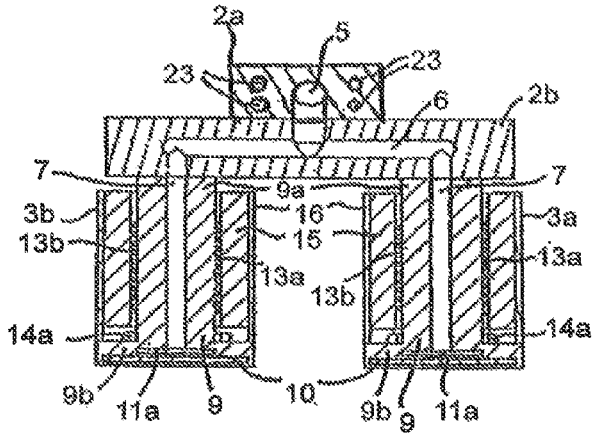
FIG. 3 is a longitudinal sectional view of the feed system of FIG. 1 taken along line III-III in FIG. 1.
Figure 5:
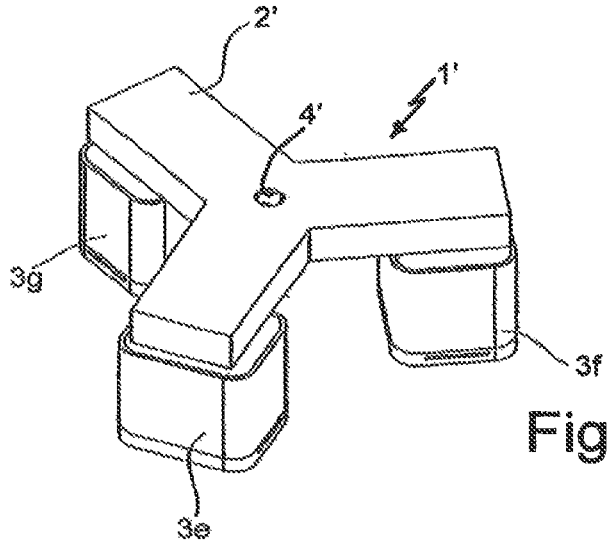
FIG. 5 is a schematic perspective view of a further hot-runner feed system in a star-shaped configuration.

FIG. 5 shows, by way of example, a configuration of a hot-runner feed system 1' according to the invention which includes three feed block units 3*e*, 3*f*, 3*g* constructed as shown in FIGS. 2 and 3, in a star-shaped, triangular arrangement with a manifold block structure which is formed by a single, three-point manifold block 2' having a central feed mouthpiece 4' on its inlet side. In each of the three arms of this manifold block 2' there extends, in a manner which is not shown, a respective runner channel from the inlet-side feed mouthpiece 4' to the supply channel inlet of the respective feed block unit 3*e*, 3*f*, 3*g*. The manifold block 2' and the feed block units 3*e*, 3*f*, 3*g* are assigned in an identical manner, as described above for the exemplary embodiment shown in FIGS. 1 to 4, separately controllable heating elements with associated individual heating control circuits and an assigned central control unit, there being no need to give a repeated description of them here. Moreover, the hot-runner feed system 1' of FIG. 5 corresponds in its mode of operation and its advantages to the system shown in FIGS. 1 to 4, to which reference can be made.

As stated, the modular hot-runner feed system according to the invention is suited, for example, to hot-chamber pressure die-casting machines; however, it can also be used in an identical manner for pressure die-casting machines of the cold chamber type.

The foregoing disclosure has been set forth merely to illustrate one or more embodiments of the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A control device for a pressure die-casting machine having a hot-runner feed system with associated feed system temperature sensors, wherein the control device is operatively configured to receive temperature information from the feed system temperature sensors and to control a mould-filling operation of the pressure die-casting machine dependent on said received temperature information, wherein the control device is operatively configured to authorize a mould-filling operation of the pressure die-casting machine only when one or more temperatures in the hot-runner feed system detected by the feed system temperature sensors lie within a respectively predetermined setpoint temperature range.

2. A control device for a pressure die-casting machine having a hot-runner feed system with associated feed system temperature sensors, wherein the control device is operatively configured to receive temperature information from the feed system temperature sensors and to control a mould-filling operation of the pressure die-casting machine dependent on said received temperature information, and a heating control circuit for controlled heating of at least one feed block unit of the hot-runner feed system, wherein the heating control circuit comprises at least two heating elements for a respective feed block unit, which are controllable individually to set a predetermined temperature profile.

3. The control device according to claim 2, wherein the at least two heating elements comprise at least a first heating device for heating a supply channel of the respective feed block unit and a second heating device for heating a sprue channel of the respective feed block unit leading from the supply channel to an associated sprue orifice adjacent to a gate.

4. The control device according to claim 3, wherein the at least two heating elements are integrated into a block body of the respective feed block unit.

* * * * *